United States Patent [19]

Ford et al.

[11] 4,178,709

[45] Dec. 18, 1979

[54] MACHINE FOR USE IN PICTORIAL DRAFTING

[76] Inventors: Alan T. Ford, P.O. Box 531, Green Harbor, Mass. 02041; Norman G. Graf, 255 High St., Hingham, Mass. 02043

[21] Appl. No.: 702,674

[22] Filed: Jul. 6, 1976

[51] Int. Cl.[2] ..... G09F 11/18

[52] U.S. Cl. ..... 40/471; 40/502; 40/503

[58] Field of Search ..... 40/86 R, 86 A, 518, 40/471; 240/2 AT; 352/129; 33/76 R; 312/231

[56] References Cited

U.S. PATENT DOCUMENTS

| | | | |
|---|---|---|---|
| 1,422,641 | 7/1922 | Walters | 33/76 |
| 1,559,665 | 11/1925 | Beery et al. | 40/86 R |
| 2,608,780 | 9/1952 | Mishler | 40/86 R |
| 2,692,529 | 10/1954 | Halahan et al. | 352/129 |

OTHER PUBLICATIONS

"Alvin General Catalog", 1971, pp. 132–134.

*Primary Examiner*—Louis G. Mancene
*Assistant Examiner*—John J. Wilson
*Attorney, Agent, or Firm*—Morse, Altman, Oates & Bello

[57] ABSTRACT

A machine is provided for use by draftsmen, illustrators and artists in making various axonometric or three dimensional drawings, such as isometric, dimetric, trimetric as well as perspective views. The machine includes a flat working surface which supports drafting paper or the like placed thereon. Provided along the borders of the working surface and visible to the draftsman are changeable construction guide lines along with ellipse angle selection data by use of which the draftsman may prepare various types of three dimensional views. The construction guide reference lines in one embodiment are provided by means of a printed chart on a roll which moves under the working surface, and by moving the chart in one direction or the other the reference lines may be moved according to the requirements of the drawing to be made. Each roll may contain a number of different construction guide lines at different angles in order to make a wide variety of three dimensional views such as isometric, dimetric, trimetric and the like. When used to produce perspective illustrations, each group of depth of field lines is provided with corresponding ellipse angle information whereby three dimensional views may be prepared without the usual plotting requirements and a wide range of scale elevation, distance and perspective angle are readily available.

15 Claims, 10 Drawing Figures

MACHINE FOR USE IN PICTORIAL DRAFTING

BACKGROUND OF THE INVENTION

1. Field of the Invention

This invention relates generally to drafting equipment, and more particularly is directed towards a new and improved drafting machine providing changeable construction guide lines and ellipse angle information for use in preparing three dimensional views.

2. Description of the Prior Art

In making axonometric projections a draftsman must do a substantial amount of preparation before starting his drawing in order to calculate the various angles and dimensions. As a result, the making of an axonometric projection or perspective view, even with the use of various types of drafting scales, grids, ellipse selectors, oblique line scalers, protractors, guides, and the like, is a time consuming affair. While various types of drafting tables and boards have been available for use by draftsmen making drawings, including boards with underlying grids, visible through transparent drawing material, none of the equipment heretofore available has been capable of providing a wide variety of construction guide and depth of field lines along with associated ellipse angle information for use in preparing drawings on either opaque or transparent material.

Accordingly, it is an object of the present invention to provide a new and improved drafting apparatus for use in preparing a wide variety of axonometric and perspective views in various angles along with ellipse angle data proper to the view being drawn. Another object of this invention is to provide a drafting machine for use particularly in making perspective views, along with a changeable display of typical perspective views showing angle numbers and other relevant data.

SUMMARY OF THE INVENTION

This invention features a drafting machine for use in making axonometric or prespective drawings comprising a flat working surface adapted to support sheet drawing material placed thereon. The support, in the preferred embodiment, is opaque while changeable construction guide lines are visible along at least the sides thereof, whereby when using a straight edge the draftsman may use the lines as a reference in making the drawing. Across the top of the working surface there are visible changeable indicia providing ellipse angle selection information appropriate to the particular depth of field lines visible along the sides of the board. In the preferred form of the invention, the depth of field lines and ellipse angle selection numbers are preprinted on a roll of chart paper, for example, and pass underneath the working surface with the reference lines and angle numbers visible about the border of the working surface. Movement of the chart in either direction serves to change the centerline of the drawing as well as to bring in new depth of field lines and ellipse information for different projections. This invention also includes a variable display of typical axonometric views as an aid to the draftsman in selecting the best view to be made of a subject.

DETAILED DESCRIPTION OF THE PREFERRED EMBODIMENTS

A draftsman, illustrator or artist who wishes to illustrate a perspective view, particularly one of an architectural or mechanical subject, generally lays out the subject by boxing in the object to be illustrated. In making the initial layout, the first problem to consider is the attitude or spatial location of a box or cube, the cubes attitude in space being determined by the position of the viewer. Assuming that the viewer is looking at one vertical edge of a cube with the other two edges at equal distances from the central edge, the viewer will then determine whether he wishes to look up at the bottom surface or down at the top surface. This attitude is a function of the horizon line with respect to the point of intersection with the forward perpendicular edge or extension thereof and is referred to as "tilt". The tilt downward will increase as the cube is lowered from the horizon line and decrease as it is raised.

The next consideration for the draftsman is whether the faces of the cube to the left and the right of the foremost vertical edge are to be equal or whether it would be preferable to show more of one side than the other. This position of the object is referred to as "rotation" and its direction is either clockwise or counterclockwise.

While perspective views may be drawn using conventional grids made up of matrix lines and intersections, these grids are useful only in conjunction with translucent paper which allows a grid line to be traced onto the material. Such permanent grids do not allow the rendering of a view on opaque material. Drawing material which has been preprinted with background grid lines is unsuitable for many types of work because the grid lines remain on the original work. In the present invention, these problems are avoided by allowing original, axonometric or perspective views to be prepared on the finish sheet which is clear of any other reference lines so that the illustrator may use any type of material for his basic layout, including both translucent as well as opaque materials.

Figure 1:
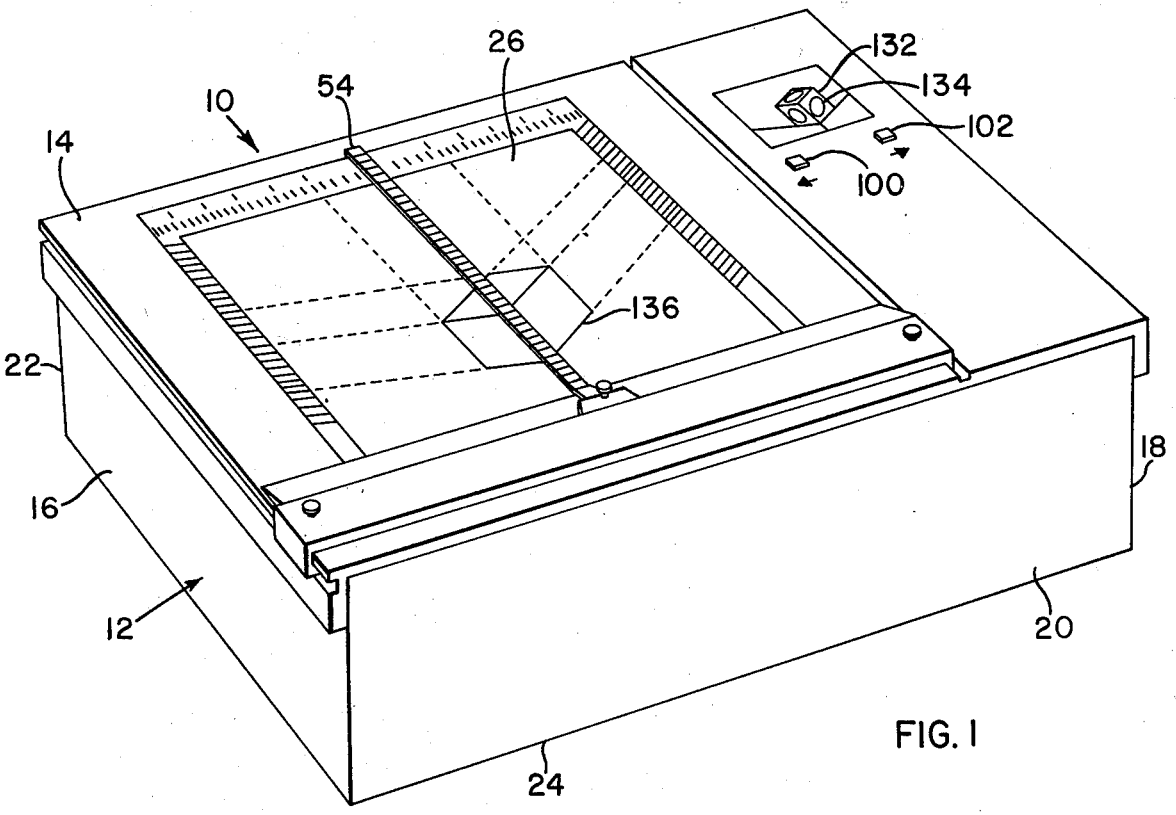
FIG. 1 is a view in perspective of a drafting machine made according to the invention.
Figure 2:
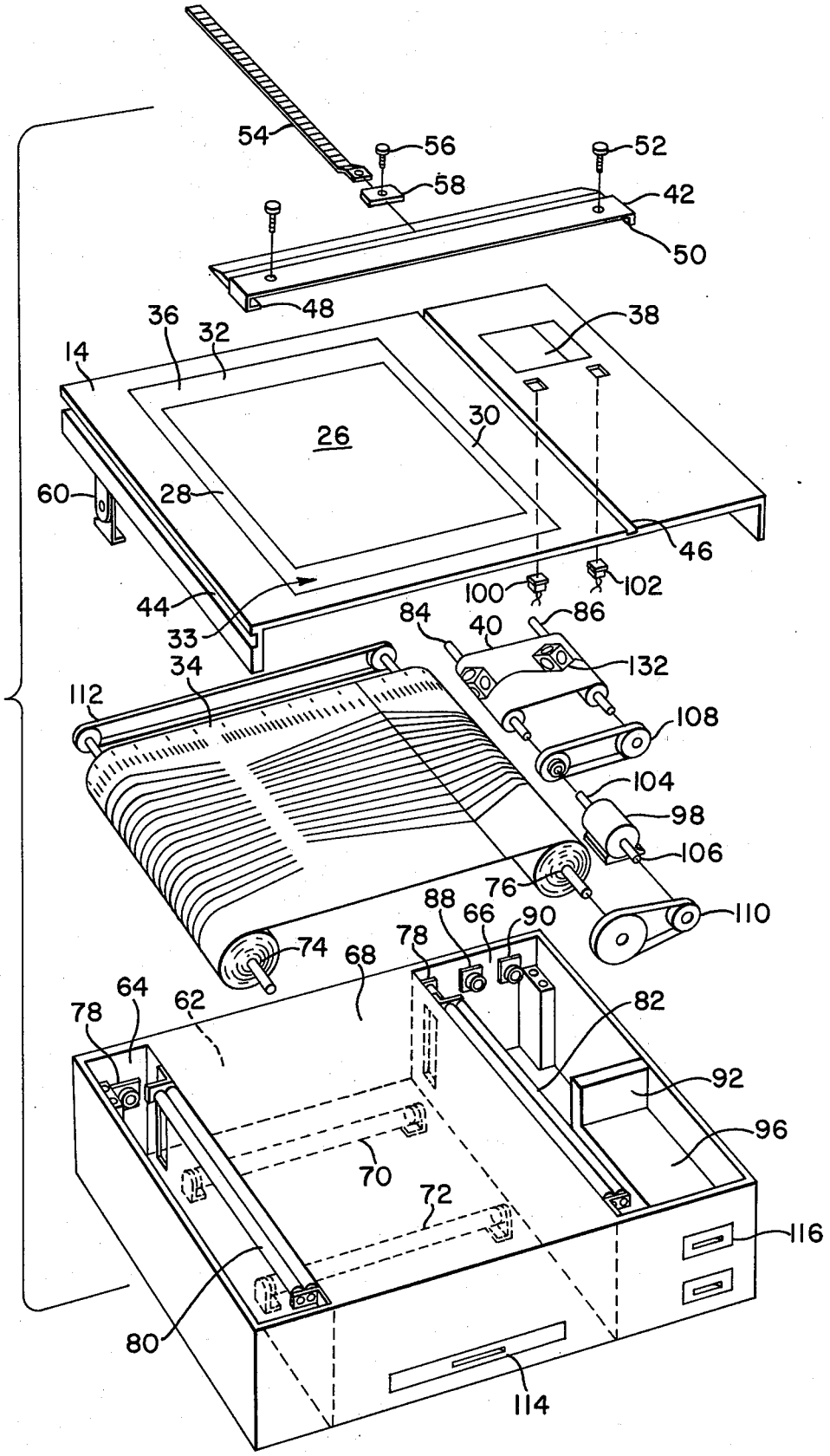
FIG. 2 is an exploded perspective view of the FIG. 1 machine.

Referring now to the drawings and to FIG. 1 in particular, the reference character 10 generally indicates a drafting machine organized about a housing 12 which, in the FIG. 1 embodiment, is a small portable unit. The drafting machine 10 includes a top wall 14, side walls 16 and 18, front and rear walls 20 and 22, and a bottom wall 24. The top wall 14 includes a flat drafting board 26 adapted to support a sheet of drafting material, such as paper, bristol board, translucent linens, or the like. The drafting board 26 typically is rectangular and may be an integral part of the top wall 14 as best shown in FIG. 2.

Slot openings 28, 30, 32 and 33 are formed along the two sides of the drafting board 26 and along the top and bottom thereof in order to expose portions of a chart 34 disposed below the board and the top wall 14. Preferably, a rigid, transparent window 36 of glass, acrylic plastic, or the like, is mounted within the slots in order to provide smooth, flush, upper and lower surfaces for the board 26 and top wall 14. Alternatively the entire top wall 14 may be of transparent, rigid material designed with opaque portions defining the transparent slots.

Adjacent to the board 26 and to one side of the top wall is an opening 38 which also may be provided with a panel of glass or other transparent, rigid material through which may be seen a section of a changeable ellipse angle display 40 located behind the window opening 38. The top wall of the illustrated embodiment includes a straight edge 42 slidably connected for movement from the top to the bottom of the board by means of grooves 44 and 46 receiving cooperating tongues 48 and 50 formed on the end of the straight edge. Clamping screws 52 are provided to permit the straight edge to be locked in any given position. Attached to the straight edge is a ruler 54 pivotally connected at its end by means of a screw and pad 56 and 58 mounted to the center of the straight edge. The mounting allows the ruler 54 to be swiveled to any angle over the face of the board 26.

In order to allow the board to be raised at a comfortable angle when in use, extension links 60 may be provided.

The housing 12 below the top 14 is a boxed, rectangular arrangement comprised of three compartments, namely, a center compartment 62 and a pair of side compartments 64 and 66. The center compartment 62 is of a length and width generally corresponding with the dimensions of the board 26 and its surrounding slots 28, 30 and 32. The compartment is covered by a transparent top wall 68 which underlies the board 26 and supports the underside of the chart 34 which is drawn between the wall 68 and the board 26. The chart sections exposed through the slots 28, 30 and 32 are illuminated by one or more light sources within the central compartment 62 and, preferably, fluorescent fixtures 70 and 72 are provided to generate a cool, bright light sufficient to penetrate through the translucent chart 34 so that the various markings will be visible to the draftsman through the slots 28, 30 and 32.

The chart 34 is wound on rolls 74 and 76 with the roll 74 mounted in the compartment 64 while the roll 76 is mounted in the compartment 66. Brackets 78 are mounted at opposite ends of each of the compartments 64 and 66 to support the ends of the rolls 74 and 76. Mounted on the inboard walls of each of the side compartments 64 and 66 near the top edges thereof are sets of guide rollers 80 and 82 through which the chart 34 is threaded. In this fashion the chart 34 may be advanced to the right or the left by taking up on either of the rolls 74 and 76, and the chart will be guided properly below the board 26 with the depth of field and ellipse angle indicia appearing appropriately in the slots 28, 30 and 32 as will be described below.

The compartment 66 is made larger than compartment 64 in order to accommodate the ellipse angle display strip 40 which, in practice, is smaller than the chart 34 and wound on rolls 84 and 86. Cooperating brackets 88 and 90 are provided to support the ends of the rolls 84 and 86 so that the display on the strip will be visible through the window 38. A transverse wall 92 is provided to support the opposite ends of the rolls 84 and 86 which do not run the full length of the compartment. The wall also serves to support a horizontal platform 96 to support a reversible motor 98 whose direction of rotation is controlled by means of a pair of normally open switches actuated by control buttons 100 and 102 accessible from the front face of the top wall. The motor 98 is provided with two drive shafts 104 and 106 with the drive shaft 104 connected by means of a belt and pulley system 108 to the rolls 84 and 86 for the ellipse angle display strip 40. The motor shaft 106, in turn, is connected by a belt and pulley system 110 to the roll 76 for the chart 34. In order that both rolls 74 and 76 move in unison, the roll 74 may be spring loaded in order that it will rewind when the chart is being moved to the left. Preferably, however, the two rolls are connected to one another by a belt and pulley system 112. The arrangement for driving the chart 34 and strip 40 provides synchronization of movement so that at all times the ellipse angle views visible through the window 38 will correspond and correlate with the depth of field indicia visible through the slots 28, 30 and 32.

Optionally, drawers 114 and 116 may be provided in the housing to store drafting instruments or the like.

In lieu of the motor drive system which advances the shaft and the ellipse angle display strip in unison, the rolls for the chart and strip may be operated manually by exterior knobs connected to each of the rolls. The chart 34 is made of a flexible, translucent material, and for this purpose a high quality chart paper or a plastic film, such as Mylar or the like, may be used to advantage. In any event, the chart is comprised of a number of different sets of construction guide lines and related ellipse angle indicia. For example, in FIG. 3 there are illustrated construction guide lines 118 which extend from both sides of a vertical centerline 120 towards vanishing points which intersect a horizontal line 122 midway between the upper and lower limits of the vertical centerline 120. Thus, the upper construction guide lines converge outwardly and downwardly, while the lower depth of field lines converge outwardly and upwardly all towards the horizontal line 122. The several depth of field lines are individually marked according to the angle of inclination with respect to the horizontal, and the depth of field lines may be printed in alternating solid and broken lines to provide a greater resolution and flexibility in the use of the lines.

Figure 3:
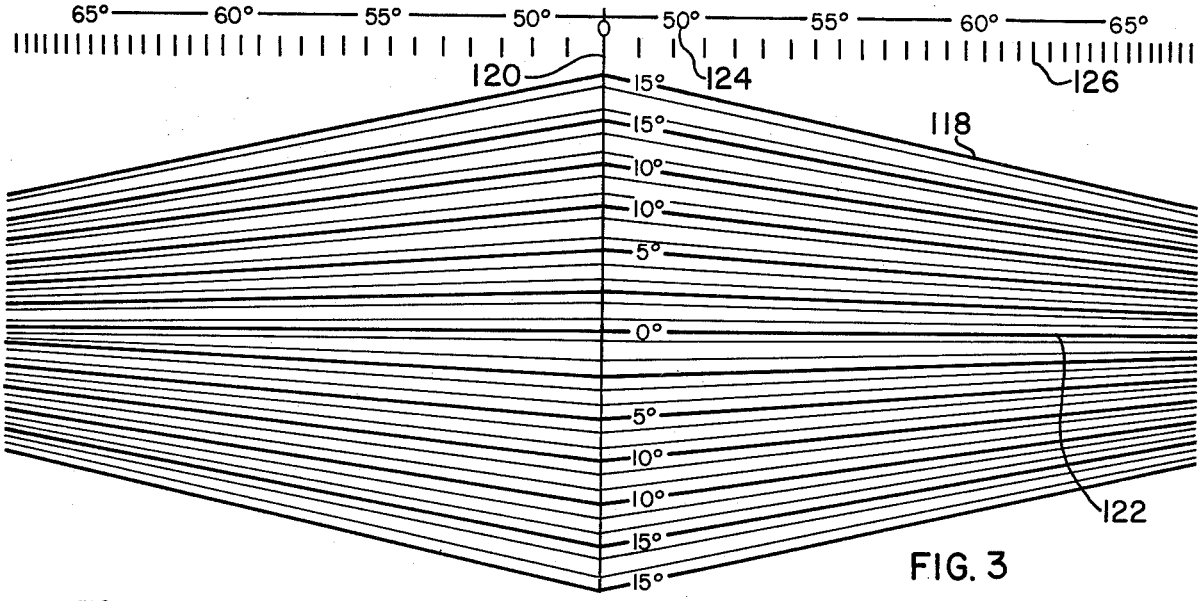
FIGS. 3, 4 and 5 are plan views of three different charts for use with the principal embodiment by means of which different perspective or axonometric drawings may be made.

Extending across the top of the chart section in FIG. 3 are angle numbers 124 which increase in size from either side of the centerline 120 and provide ellipse angle information for the side faces of the drawing being made according to the location of the ellipse to be drawn in relation to the centerline. Directly under the ellipse angle line are a series of graduated markings 126 providing vertical spacing reference lines for the draftsman.

Figure 4:
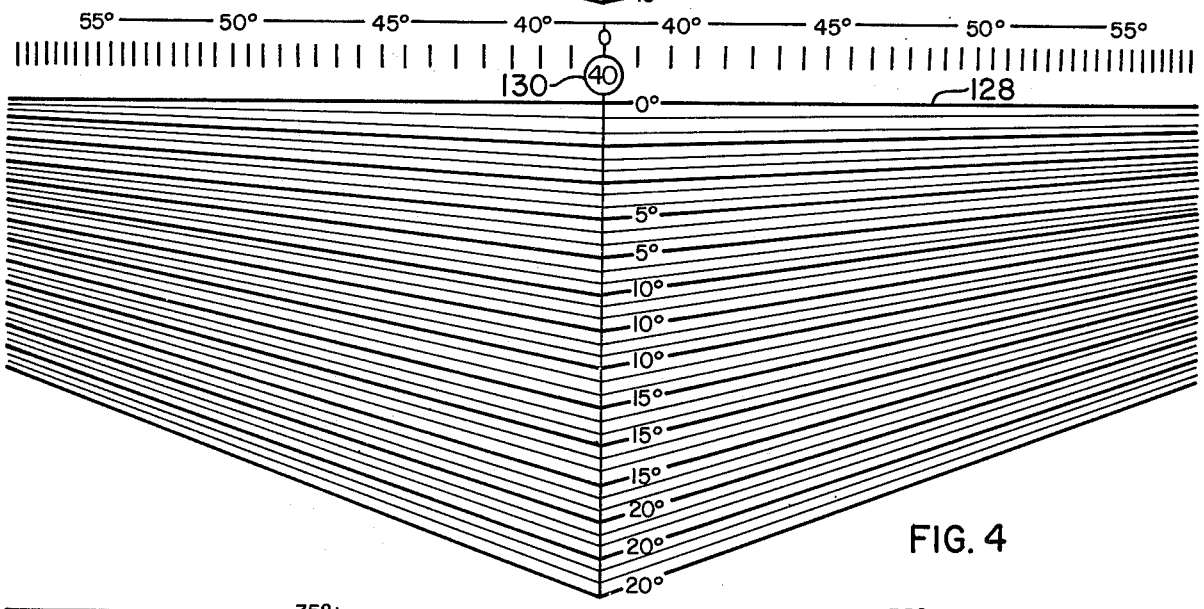
Figure 5:
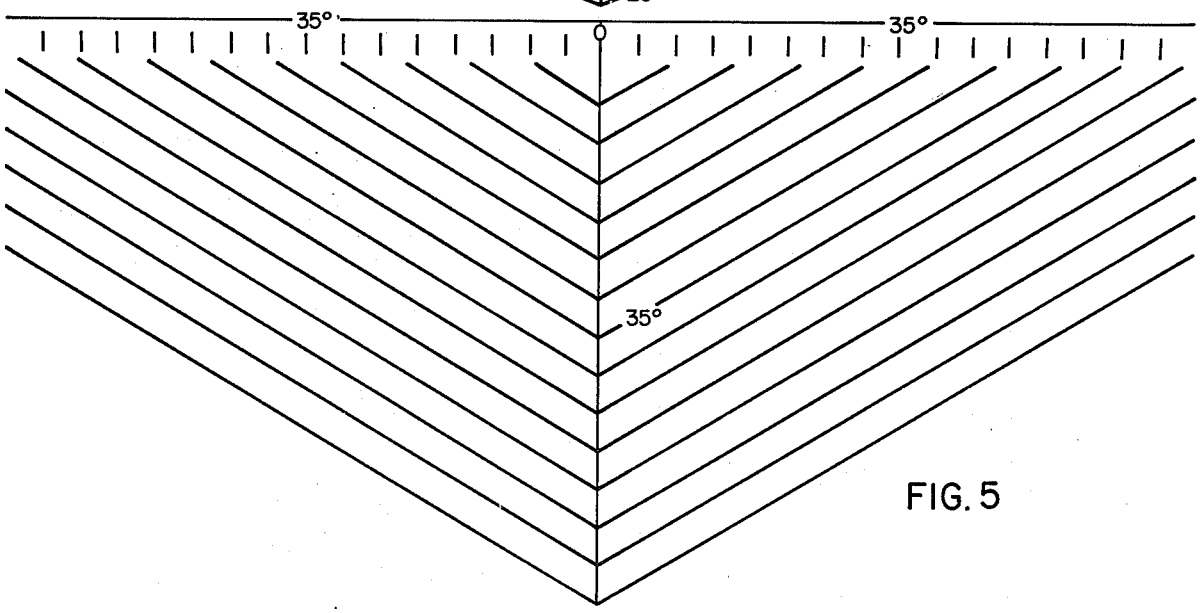

FIG. 4 shows a chart similar to FIG. 3 with the exception that the horizontal line 128 is at the top of a set of depth of field lines representing a change in perspective with respect to FIG. 3. FIG. 5 shows construction guide lines for use in making an isometric projection in which all the depth of field lines are parallel as is the case with a true isometric view.

Depth of field or construction guide lines 118 may be printed in black for use in drawing the foremost construction line while intermediate, more closely spaced lines may be a bright orange, for example, for use in drawing the rearmost construction lines and to render them easily visible and distinguishable from other lines. The angle numbers appearing on the depth of field lines proximate to the centerline 120 may be repeated at spaced increments laterally along each depth of field line so as to be visible through the slots 28 and 30 at all chart positions. These angle numbers indicate the particular ellipse angle to be used on the top or bottom face of the drawing that is being made. Similarly, the graduated markings 126 may be printed in a different color for easy identification, and these graduated markings are employed to indicate the number of units depicting scale measurement divisions of the horizon line 122. If desired, each chart may also be provided with an identifying angle selection number 130 which corresponds with an angle selection number printed on the appropriate ellipse display of the strip 40.

The strip 40 is printed with a number of typical views which the draftsman may refer to in selecting the angle view best suited to illustrate the subject matter. These views preferably are cubes 132 tilted and rotated at various angles demonstrating typical axonometric and perspective views. The cube is employed since it is ideal for demonstrating different views. Each visible face of the illustrated cube is provided with an ellipse 134 which carries an identifying angle. Also, the bottom edge of each cube is located along a depth of field or construction guide line intersecting at a centerline. Suitable depth of field angles are preprinted in a close association to these lines.

While it is preferable to show the typical views by means of a separate strip visible through a separate window, the views could be incorporated on the larger chart 34 for viewing through one of the slots or other opening.

The apparatus is used in the following manner. The illustrator first selects the overall view to be made, whether isometric, dimetric or the like, by moving the strip 40 back and forth until he finds a view which best corresponds to the view he wishes to prepare. If the strip 40 and chart 34 are operatively interconnected, as shown in the principal embodiment, the appropriate depth of field chart will be in position, automatically, to correspond with the view appearing in the window 38. If the strip and chart are not interconnected, then the appropriate set of depth of field lines is manually advanced so that the angle selection number 130 on the chart corresponds to the angle selection number on the strip. Once the strip and chart are in correspondence, the illustrator positions the centerline 120 of the chart according to the centerline of the view to be made. This may fall in the center of the board or, if the particular figure being illustrated is offset, then the centerline should be moved to the right or left as required. Any movement of the centerline will, of course, change the depth of field lines visible through the slots on each side of the drafting board. Once the particular section of the chart has been positioned with respect to the centerline as it appears through the slot 32, the draftsman is now ready to start his illustration.

As shown in FIG. 1, assuming he is drawing a cube 136, for example, the straight edge 54 is aligned with the centerline 120 on the chart appearing at the top of the board through the slot 32. The draftsman then draws in the forward vertical edge of the cube and the appropriate height may be measured by graduated markings on the straight edge 54. The other vertical lines may then be drawn in using the graduated markings 126 as a guide. Once the vertical lines have been established the draftsman may then use the portions of the construction or depth of field lines 118 appearing on both sides of the drafting board as a reference in projecting the depth of field lines to form the other edges of the cube. This is done by tilting the straight edge 54 or by using a separate straight edge placed across and aligned with the proper depth of field line appearing through the slots and extending the straight edge across the surface of the board, as suggested in FIG. 1. Using these depth of field lines as a reference, the cube is completed at the proper angle. Assuming that ellipses are to be illustrated on one or more of the faces of the cube, the ellipse angle is immediately shown in the view through the window 38 for each face of the cube. Ellipse angle data is also provided on the top of the chart through the slot 32 so that no calculations are required. The draftsman merely selects an appropriate template corresponding to the ellipse angle and draws in the ellipse as required.

If additional views are to be drawn on the same sheet, the chart is moved to bring the centerline into proper position for the next view. Each movement of the chart automatically arranges the depth of field lines along the edges of the board and also presents proper ellipse angle information along the top of the board. If another view is to be drawn on the same sheet or on a separate sheet at a different viewing angle, an appropriate chart is advanced into position giving new depth of field lines and appropriate ellipse angle information. A view may be drawn on a worksheet at any location desired since the centerline for the underlying chart may be moved and viewed at any position across the top through the slot 32. The depth of field lines are sufficiently long so that they will at all times be visible irrespective of the position of the centerline, whether it be at an extreme lefthand or righthand position. The drafting may be done on a single sheet of drafting material placed on the board area or, if desired, the apparatus may be modified to accommodate a roll of drafting material fed from top to bottom perpendicularly to the length of the chart. In such a modification appropriate slot openings will be formed along the top and bottom edges of the top wall 14 and feed and take-up roll supports for the drafting material will be provided internally of the housing. Also, a suitable cranking mechanism or power advance drive will be provided to move the material.

Figure 6:
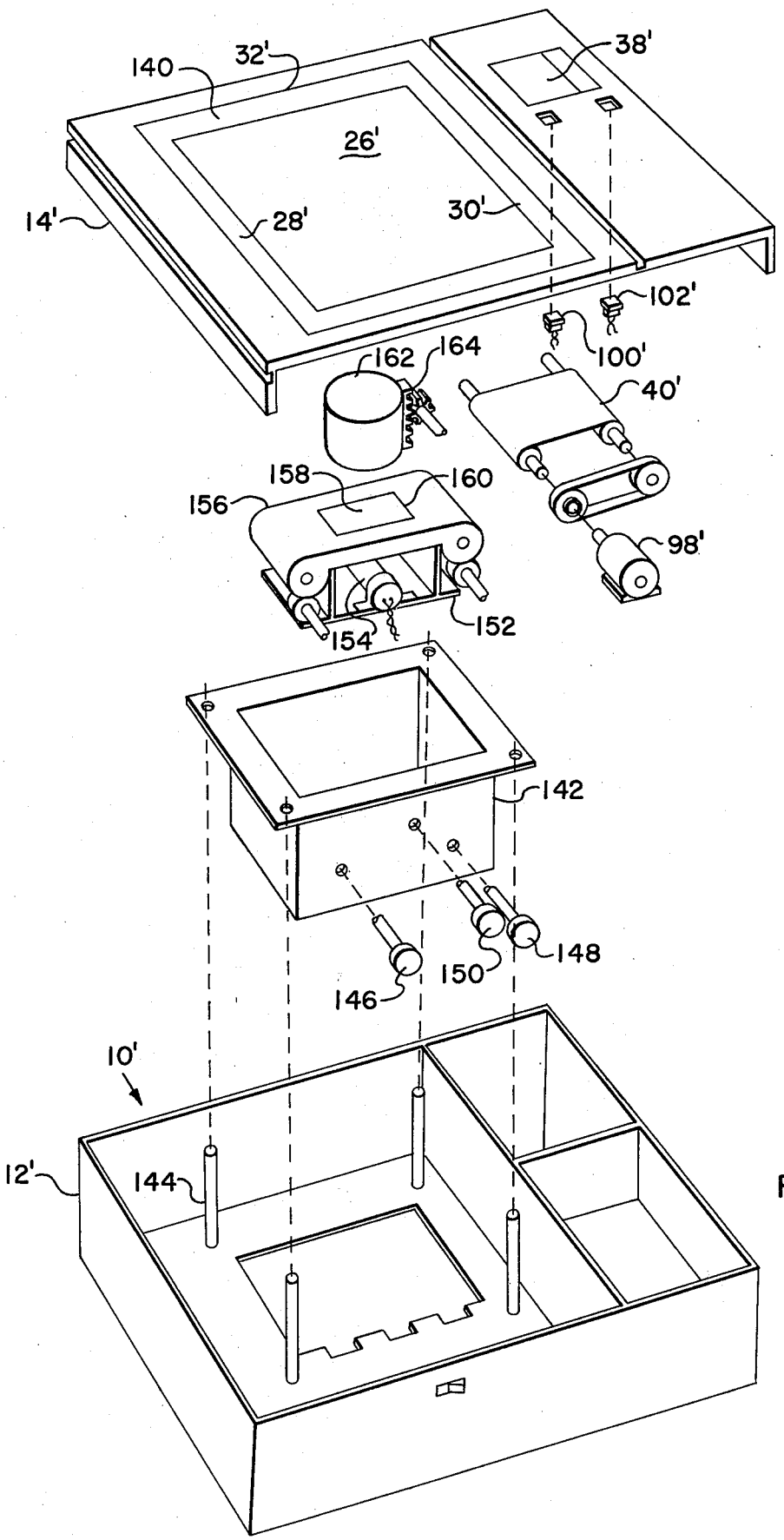
FIG. 6 is an exploded perspective view showing a modification of the invention.

Referring now to FIG. 6 of the drawing, there is illustrated a modification of the invention. In this embodiment depth of field lines and ellipse angle data are optically projected for viewing by the draftsman around the border of his work. The FIG. 6 apparatus outwardly is similar to that of the principal embodiment and includes a housing 12' and a top wall 14' similar to the top of the wall 14 of the FIG. 1 embodiment. The top wall includes a drafting board area 26' surrounded on three sides by slots 28', 30' and 32', which slots preferably support a viewing screen 140 of a translucent material suitable for rear projection viewing, and for this purpose ground glass or other suitable material may be used to advantage. To the right of the board 26' is a window 38' through which ellipse angle displays are visible on a strip 40' similar to that of the principal embodiment. The strip 40' is mounted in the same fashion as in the principal embodiment and is driven by a reversible motor 98' using control switches 100' and 102'.

Within the main housing 12' is a projection unit comprised of an inner housing 142 positioned by pins 144 and provided with three control rods 146, 148 and 150, the outer ends of which are located on the outside of the main housing 12'. Within the housing 152 is mounted a sub-assembly comprised of a bracket 152 supporting a projection lamp 154 positioned below a cassette 156 which is loaded with a strip of projection film 158, a portion of which is visible through a rectangular opening 160 in the center wall of the cassette. The film 158 is relatively long and is wound on spools within each side of the cassette. The film carries images of chart sections similar to those on the chart 34 of the principal embodiment and includes a number of depth of field lines and ellipse angle data on a reduced scale. A projection lens 162 is mounted above the bracket and is provided with a focusing control involving a rack and pinion 164 for moving the lens up and down in order to focus the image projected by the lamp 154. The pinion is operatively connected to the control rod 150 while the control rods 146 and 148 connect to the cassette spools for moving the film back and forth as required. When the lamp is illuminated the image on the film is projected up against the bottom side of the top wall 14', with the depth of field lines appearing in the viewing slots 28' and 30' while ellipse angle data and other lines appear in the slot 32' against the screen 140.

Figure 7:
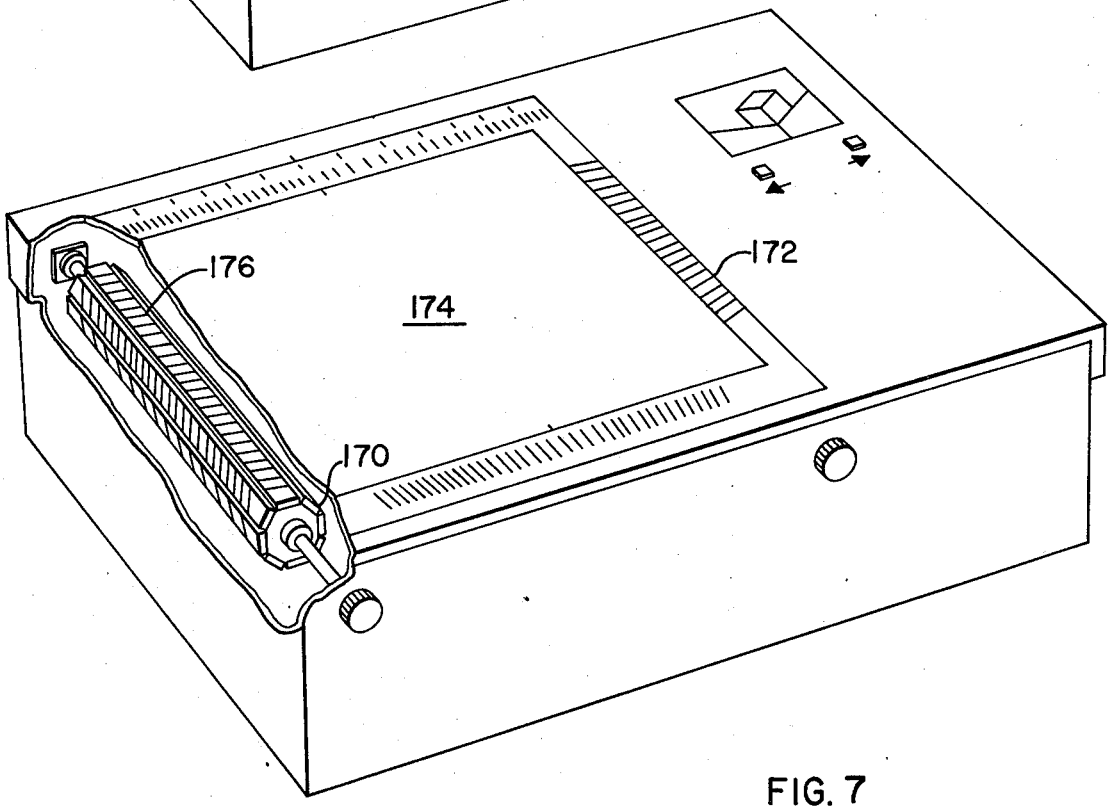
FIG. 7 is a view in perspective, partially broken away, showing a further modification of the invention.

Referring now to FIG. 7 of the drawings, there is illustrated a further modification of the invention. In this embodiment changeable depth of field lines and ellipse angle data may be presented by means of rolls 170 and 172 mounted below the top wall of a drafting apparatus on each side of a board 174. The rolls 170 and 172 extend parallel to the side edges of the board 174 and preferably are faceted lengthwise so that the rolls will be octagonal in cross-section, each facet of the roll bears depth of field lines 176 appropriate to a particular axonometric view as selected by the draftsman. Corresponding depth of field lines are provided on the roll 172 and depth at the field lines may be brought into view by rotating the rolls according to the particular view being illustrated.

Figure 8:
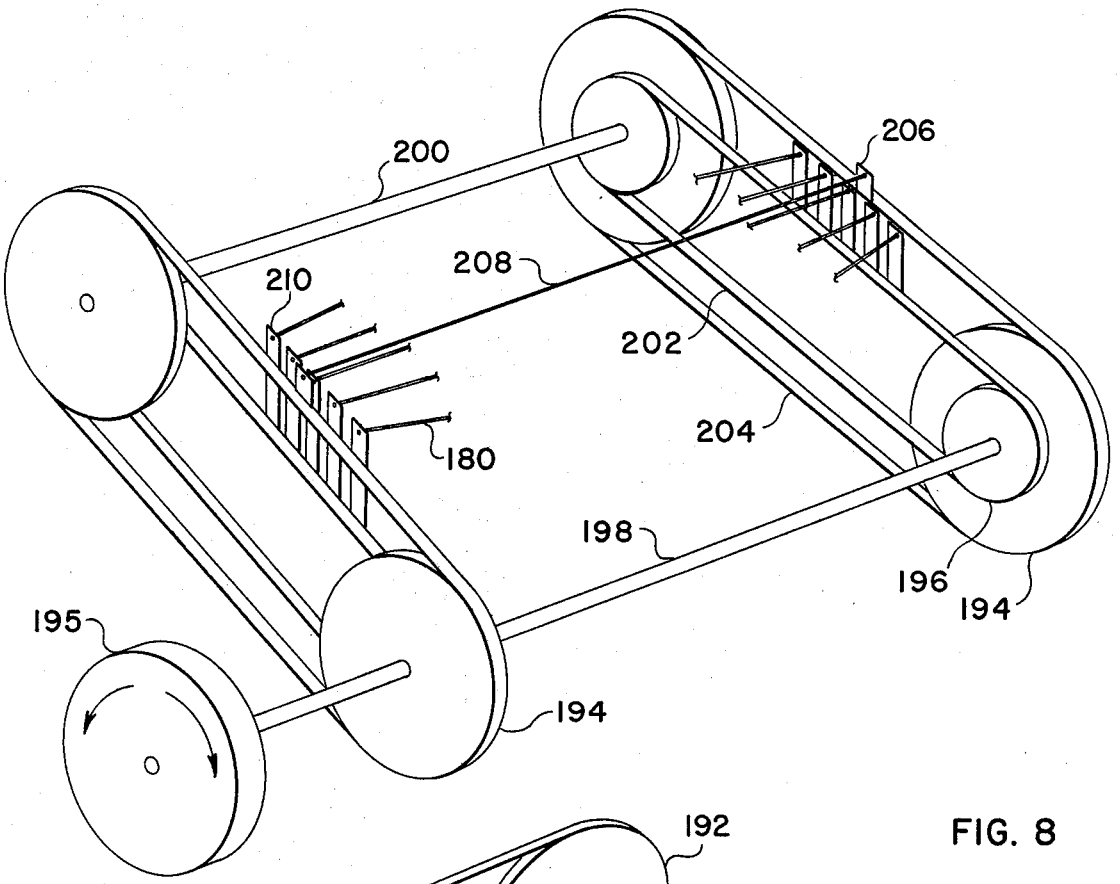
FIG. 8 is a view in perspective showing still another modification of the invention.
Figure 8:
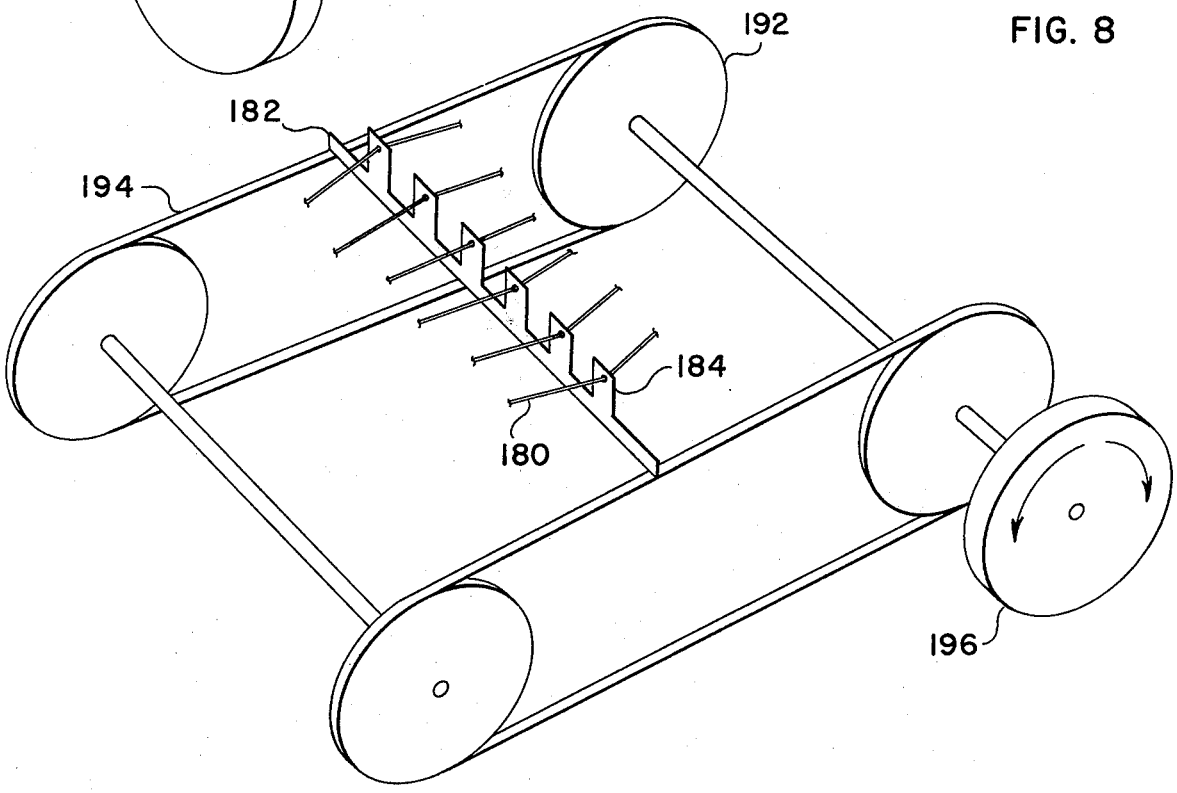

Referring now to FIG. 8 of the drawings, there is illustrated a further modification of the invention, and in this embodiment changeable depth of field reference lines are provided by means of movable strands 180 which may be of wire, string, filament, or the like. These strands are mounted within a housing (not shown) similar to that of the principal embodiment, and the strands are adjustable through a wide range of angular and spatial settings through two pulley systems, as illustrated. The first system involves a centerline platform slide 182 carrying a plurality of vanishing point and centerline control blocks 184 which engage the strands 180. Pulleys 192, arranged in pairs, connect to belts 194 which support the platform slide 182 and, by means of a control wheel 196, the platform slide 182 may be moved to the right or left to change the station point of the viewer (centerline of the sheet) and thereby control the rotation of the object being drawn.

The other ends of the strands are connected to a second pulley system which controls the horizon and lefthand and righthand vanishing points to provide tilt control over the view to be drawn. The second pulley system involves pulleys 194 and 196 arranged in four pairs, two pairs on each of two shafts 198 and 200. The smaller, inner pulleys 196 are connected by belts 202 while the larger, outer pulleys 194 are connected by belts 204. Each belt 204 carries a horizon line indicating holder 206 supporting opposite ends of a horizon line indicating strand 208. Movement of the pulleys 194 will move the horizon line strand up and down as required and always in a straight condition. A belt 202 carries a group of vanishing point line holders 210 which connect to the outer ends of the strands 180. Movement of the pulleys 196 will move the strands up and down as required. The holders 210 are apart from one another by a distance that is one-half the spacing between the centerline control blocks 184 so that there is a 2:1 movement ratio between the horizon indicator lines and the center grid lines.

Various other measures may be employed to provide variable construction guide lines and ellipse angle information about the border of the drafting area, and for this purpose light emitting diodes, elongated Nixie-type tube indicators or cathode ray tube displays may be provided. Also, the depth of field and ellipse angle information may be electronically stored and controlled using electronic data processing techniques.

Figure 9:
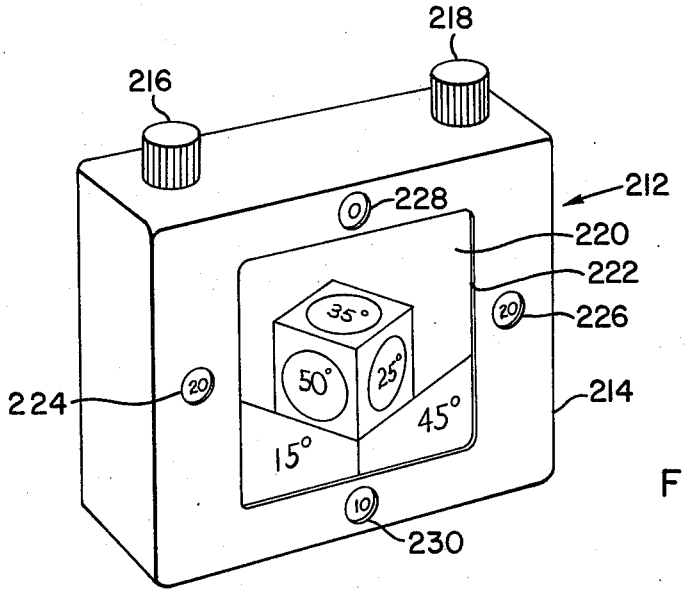
FIG. 9 is a view in perspective showing an individual ellipse angle indicator, and, FIG. 10 is a perspective view showing a further modification of the invention.

Referring now to FIG. 9 of the drawings, there is illustrated a further modification of the invention, and in this embodiment a module 212 is a small pocket-sized ellipse angle display unit essentially embodying the ellipse angle display mechanism of the principal embodiment to allow ellipse angle data to be displayed independently of the depth of field display. The module 212 includes a housing 214 and a pair of control knobs 216 and 218 for moving a strip chart 220 past an opening 222 in the front wall of the housing. The strip chart is similar to that of the strip 40 in the principal embodiment and, in addition, is provided with apertures 224 and 226 on either side of the opening 222 to display numbers indicating units of distance to the lefthand vanishing point through the opening 224 while the opening 226 displays another number indicating distance to the righthand vanishing point for the particular view visible through the center opening. Apertures 228 and 230 display units above and below the horizon for the particular view being shown.

Figure 10:
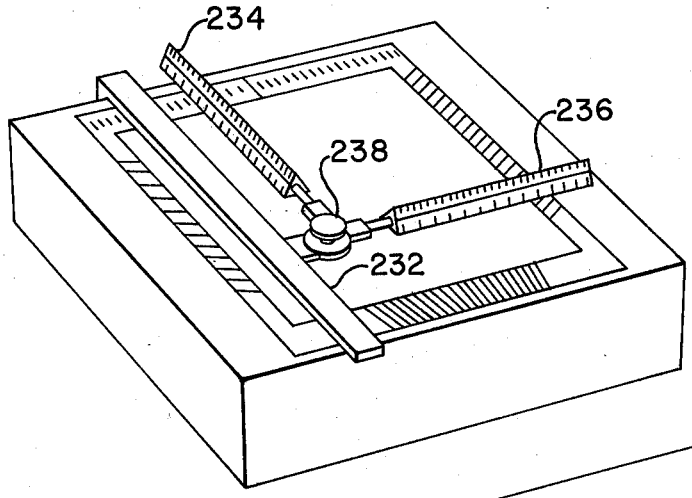

Referring now to FIG. 10 of the drawings, there is illustrated another modification of the invention, and, in this embodiment, an arm 232 is pivoted to the drafting machine and provided with a pair of mutually perpendicular engineers scales 234 and 236. The scales are connected to a hub 238 for rotation about their longitudinal axes so that different scales may be turned into viewing position, as required.

While the invention has been described with the particular reference to the illustrated embodiments, numerous modifications thereto appear to those skilled in the art.

Having thus described the invention, what we claim and desire to obtain by Letters Patent of the United States is:

1. Apparatus for use in making axonometric and perspective drawings, comprising (a) a support including a generally rectangular flat portion providing a working surface to receive a generally rectangular stratum of drafting material placed thereon, (b) a narrow elongated window located along the opposite side edges of said flat portion, and at least one of the top and bottom edges thereof beyond the edges of the drafting material and said working surface, (c) laterally movable changeable display means below said flat portion and dimensionally larger than said working surface and visible through said windows and presenting selectively changeable reference lines visible along the opposite edges of said flat portion and at least one of the top and bottom edges thereof from which axonometric and perspective drawings may be constructed on said drafting material, and (d) control means connected to said display means for changing said lines with respect to said material by laterally shifting said display means, (e) said reference lines including side reference lines along the side edges of said flat portion and scale reference lines at least along one of the top and bottom edges of said flat portion, (f) said side reference lines providing reference indicia for drawing on the drafting material lines to a projected vanishing point when constructing perspective views and parallel lines when constructing axonometric views, on said drafting material and said scale reference lines providing spacing indicia for the dimensions in said perspective views that are being progressively foreshortened along the sides of said perspective views towards a vanishing point.

2. Apparatus according to claim 1, and further including an additional viewing window in said flat portion, and a sample perspective drawing corresponding to the reference lines visible in the elongated windows, imprinted on said display means and visible through said additional viewing window.

3. Apparatus as defined in claim 1 wherein the changeable display means is in the form of an elongated web adapted to be rolled up at its ends.

4. Apparatus, according to claim 3, wherein said web also bears ellipse angle data in each set with respect to different positions on said reference lines.

5. Apparatus, according to claim 4, including a second elongated web longitudinally movable and bearing a plurality of representative views spaced therealong.

6. Apparatus, according to claim 5, wherein both of said webs are operatively connected for synchronous movement.

7. Apparatus, according to claim 1, wherein said display means includes ellipse angle data.

8. Apparatus, according to claim 7, wherein said ellipse angle data are disposed laterally and longitudinally with respect to said surface.

9. Apparatus, according to claim 1, wherein said display means includes ellipse angle data visible along the upper adjacent said flat portion and movable from side to side with respect to said flat portion.

10. Apparatus, according to claim 1, wherein said display means includes a film strip bearing thereon images of a plurality of different reference line sets spaced therealong and projection means operatively associated with said film strip for projection of individual sets about said surface within said windows.

11. Apparatus, according to claim 1, wherein said display means includes at least a pair of rollers each mounted adjacent a side edge of said surface, each of said rollers being formed with a plurality of facets, each facet bearing a set of construction guide lines and means for rotating said rollers to expose selected facets.

12. Apparatus, according to claim 1, wherein said display means includes a plurality of spaced strands mounted behind said flat portion and extending beyond the edges thereof, first means supporting the ends of said strands for movement between the upper and lower edges of said flat portion and second means engaging said strands between their ends and movable between the side edges of said flat portion, said second means separating said strands apart by a distance different from the spacing at their ends.

13. Apparatus, according to claim 1, including an elongated straight edge instrument movably mounted to said support for selective positioning on said surface, said instrument being formed with a plurality of faces each bearing a different scale, said instrument being rotatable about its longitudinal axis whereby any one of said scales may be moved into view.

14. Apparatus, according to claim 1, including illuminating means behind said surface to illuminate said display means.

15. Apparatus, according to claim 1, wherein said control means includes a reversible motor.

* * * * *